United States Patent [19]
Kostovetsky et al.
[11] 4,222,612
[45] Sep. 16, 1980

[54] METHOD OF MINING FLAT-DIPPING AND SLOPING BEDS OF A MINERAL WITH HYDRAULIC EXCAVATION

[76] Inventors: Semen P. Kostovetsky, ulitsa Suvorova, 2, kv. 14; Boris P. Odinokov, ulitsa Chernomorskaya, 2, kv. 21; Anatoly Y. Semenikhin; Anatoly E. Sankov, ulitsa Ushinskogo, 8, kv. 14; Vladimir V. Soin, ulitsa Sechenova, 7, kv. 38, all of Novokuznetsk, U.S.S.R.

[21] Appl. No.: 881,386

[22] Filed: Feb. 27, 1978

[51] Int. Cl.[2] ..... E21C 41/04; E21C 45/00
[52] U.S. Cl. ..... 299/11; 299/17; 299/19
[58] Field of Search ..... 299/11, 17–19

[56] References Cited

U.S. PATENT DOCUMENTS

| | | | |
|---|---|---|---|
| 796,499 | 8/1905 | Claghorn | 299/18 |
| 957,364 | 5/1910 | O'Toole et al. | 299/18 |
| 1,276,952 | 8/1918 | O'Toole | 299/19 X |
| 2,358,687 | 9/1944 | Cassidy et al. | 299/19 X |

FOREIGN PATENT DOCUMENTS

| | | | |
|---|---|---|---|
| 284938 | 1/1971 | U.S.S.R. | 299/17 |

OTHER PUBLICATIONS

"Hydraulic Mining of Coal", by Parkes & Grimley Mining Congress Journal, pp. 26–29, May–1975.
"Hydraulic Mining", Mitsui Mining, Ltd., 14 pp., 6–1–8–75.

*Primary Examiner*—Ernest R. Purser
*Attorney, Agent, or Firm*—J. Harold Nissen

[57] ABSTRACT

The method of mining flat-dipping and sloping beds of a mineral with hydraulic excavation which includes dividing the bed being mined into levels and sublevels. The height of the sublevels is determined by the rock geology of the bed formation. The sublevels, in their turn, are subdivided into blocks, the width of each block being short of the limit length of the steady or self-supporting outreach of the cantilever of the rock of the main roof with the given pattern of cutting into the bed with the cutting drifts and holes defining the short working faces. The spacing of the blocks being worked in the upper and lower sublevels in the direction of strata is set to preclude inter-influence of the bearing rock pressure in the blocks where the stoping work is being done. The method enables the conduction of a stable excavation of the mineral over an extended front of stoping.

6 Claims, 2 Drawing Figures

METHOD OF MINING FLAT-DIPPING AND SLOPING BEDS OF A MINERAL WITH HYDRAULIC EXCAVATION

The invention relates to the mining industry, and, more particularly, it relates to methods of underground mining of minerals, such as methods of mining flat-dipping and sloping beds of a mineral with hydraulic excavation.

The invention is predominantly designed for mining with short working faces.

There are known methods of mining flat-dipping and sloping mineral beds with hydraulic excavation of the mineral (see, for example, "Working Patterns of Stoping and Preparatory Work in Coal Mines" published by UGLETECHIZDAT Publishers, Moscow, 1971).

The bed of the mineral being mined is first divided into levels with the height by inclination of about 200 to 250 meters and more, which are then subdivided into sublevels with the height by inclination of 100 to 125 meters and more, and in the direction of strata the sublevels are divided into long columns. The size of these columns is determined by the condition of minimum cost of excavation of a unit weight of the mineral, without providing for the laws governing the action of the rock pressure. Consequently, in each column the stoping and the regeneration of the stoping front (i.e. driving of the cutting drifts) are carried out simultaneously, which involves the necessity of having a multitude of such cutting drifts in operative condition at the same time, so as to ensure that the required rate of extraction is maintained. More often than not within the outline of the column being worked, there are simultaneously operative the following cutting drifts: 2 to 4 drifts in the operating stoping faces, the same number of drifts in the standby faces and 1 or 2 cutting drifts which are being driven. Therefore, the total number of the operative cutting drifts, necessary to maintain the required rate of extraction, is as high as 7 to 14. This affects the self-supporting capacity of those portions of the column where the pattern of cutting into the bed with the drifts is particularly heavy, whereby these portions are reduced to an emergency condition which prevents further stoping work. Furthermore, the length of these weakened portions of the column being worked in cases of intense action of the rock pressure should be sufficiently great, lest the solid pillars between the cutting drifts become deformed, and the drifts are reduced to an emergency state.

Another disadvantage of the hitherto used methods arises from the fact that the cutting drifts are in the direct vicinity of the stoping faces or stopes, so that even while they are being drifted, they are susceptible to the influence of the bearing rock pressure due to the stoping work, whereby the probability of deformation and failure of these drifts rises.

It is an object of the present invention to provide for steady and downtime-free, emergency-proof extraction of a mineral.

It is another object of the present invention to extend the front of stoping and to provide for the stability of the cutting drifts.

These and other objects are attained by provision a method of mining flat-dipping and sloping beds of a mineral with short working faces and hydraulic excavation, including dividing the bed being worked into levels and subdividing these levels into sublevels of which the height is determined by the rock geology of the bed formation, and in which method, in accordance with the present invention, the sublevels are further subdivided into blocks, the width of each block being short of the limit strength of the steady or self-supporting outreach of the cantilever of the rock of the main roof of the bed, with the given pattern of cutting into the bed with the cutting drifts and holes defining the short working faces, the spacing in the strata direction of the blocks being worked in the adjacent sublevels being set to preclude inter-influence of the bearing rock pressure due to the stoping work in one block and another block.

It provides for the stability of the cutting drifts which, in its turn, provides for a steady rate of extraction of the mineable mineral, owing to the emergency-proof state of the excavation space.

Furthermore, in this manner the volume and rate of the extraction of the mineral from each block can be substantially stepped up, the same as the labor productivity, with the ultimate reduction of the mining costs.

It is expedient that the spacing in the strata direction of the blocks being worked in the adjacent sublevels should be set to be at least equal to the limit length of the steady outreach of the cantilever of the rock of the main roof of the bed being worked, with the given pattern of cutting into the bed with the cutting drifts and holes of the short working faces or stopes.

Such arrangement of the blocks being worked in the upper and lower sublevels provides for stoping in short stopes without the hazard of untimely deformation of the stoping drifts, which might have rendered them unfit for further stoping.

It is expedient that in each block, first, the cutting of the short working faces or stopes is completed, and then the stoping is carried out.

This routine of mining of each block precludes a negative influence of the stoping work on the cutting drifts of the short working faces, whereby less time and effort is spent on driving and maintaining these drifts, to say nothing of the working safety being enhanced, particularly at stoping, owing to the improved working conditions.

The present invention will be further described in connection with a preferred implementation of the herein disclosed method, with reference being had to the appended illustrative drawings, wherein.

The herein disclosed method of mining flat-dipping and sloping beds of a mineral with hydraulic excavation resides in the following.

First, a preselected area of a bed being mined is transformed into a level A of an inclined height "H", which is then contoured sloping-wise with a storage drift 1, a companion drift 2 and an airway 3. These drifts are driven along the strata direction up to the border of the level, with the inclination ensuring gravity flow of the pulp, e.g. 0.05 an more, toward the hydraulic lift chamber (not shown).

Figure 1:
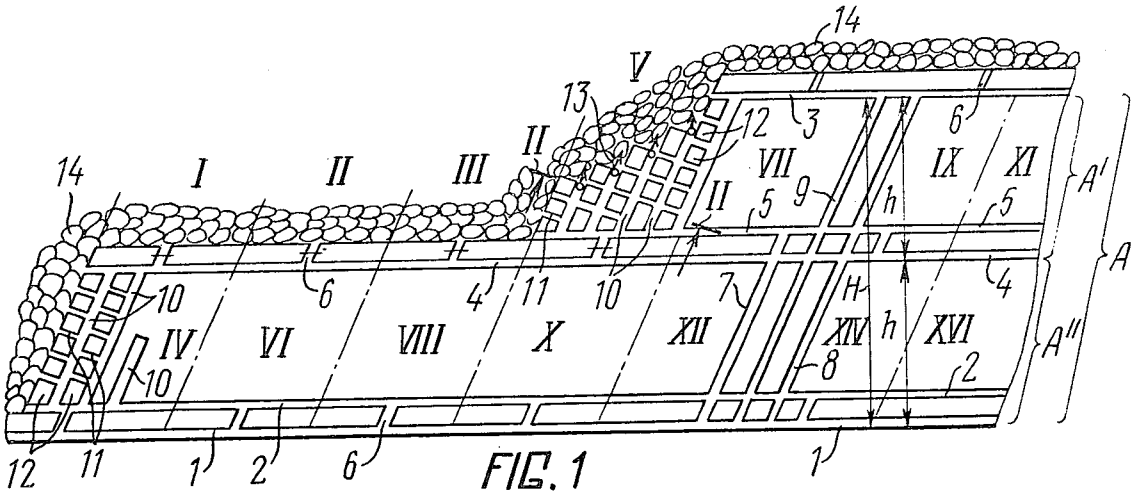
FIG. 1 shows schematically a system of mining flat-dipping and sloping beds of a mineral with hydraulic excavation in accordance with the invention, as viewed in the plane of the bed.
Figure 2:
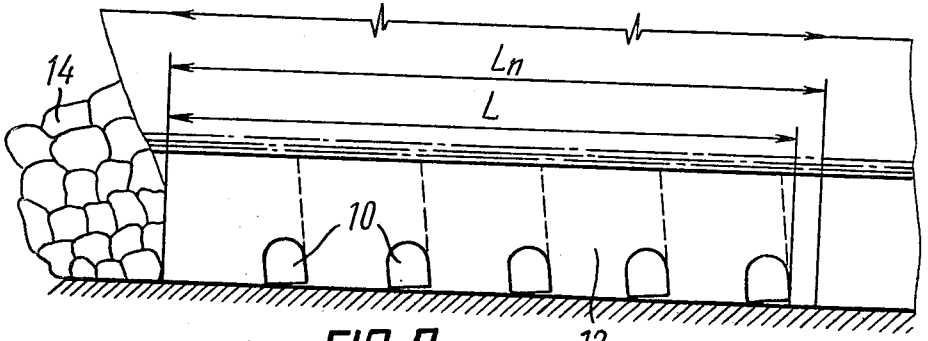
FIG. 2 is a schematic sectional view on line II—II of FIG. 1.

For a lower level, when the upper level has already been extracted, the level's airway 3 is preferably in the form of the former storage drift of this extracted level. Depending on the rock geology of the bed formation, e.g. the sloping angle, the thickness, the stability of the adjoining rock, the level is subdivided into sublevels A', A", and so on, of which the quantity and the inclination height "h" are selected to correspond to the abovesaid rock geology. This is done by driving sublevel storage drifts 4 and companion drifts 5 with the same inclination as their level counterparts. The storage drifts 1, 4 and the companion drifts 2, 5 are interconnected with holes 6 spaced to comply with the safety regulation. There can be several sublevels A', A" within a single level A; however, only two such sublevels are shown in FIG. 1 for clarity sake.

As part of complete preparation of a level for its mining with hydraulic excavation, other inclined passages are prepared, such as descent holes 7 through which the pulp would descend from the upper sublevels into the level's storage drift 1, holes 8 for mechanical lifting and lowering of the equipment and materials, and manways 9.

This done, the sublevels A', A" are subdivided still further in the strata direction into blocks I, II, III, to XVI and so on. In each such block, first, there are driven several extraction drifts 10 interconnected by holes or ducts 11 which thus define the short working faces or stopes 12. The width of the blocks I, II, III in each sublevel A', A" is taken to be short of the limit length $L_n$ of steady or self-supporting outreach of the cantilever (or cantilever overhang) of the rock of the main roof, with the given pattern of cutting into the bed with the outting drifts and holes of the short faces 12, which provides for their being in the area of the minimum display of the rock pressure.

As the extraction drifts or shafts 10 are being excavated, hydraulic lines and water jet guns 13 are installed therein. With the block having been cut to the desired pattern and the water jet guns having been installed therein, the mining work is commenced in a reverse sequence, i.e. from the sublevel border in the pulp flow direction toward the stope of the mineral in the short working faces 12, the work being done with the mineral being broken off with the high-pressure jets of water from the guns 13. The blocks I, II, III etc. are worked in the descending sequence, with those short faces having the extraction done therein in the first place, which are next to the already excavated and caved-in space 14.

As the hydraulic excavation of the mineral in the short faces 12 is carried out, the stream of the water-mineral mixture or pulp thus produced is directed through the extraction holes or shafts 10 into the storage drifts 1, 4, via the companion drifts 2, 5 and connection holes 6.

When the first block (i.e. block I) is completely excavated in the upper sublevel A', at least one, or, rather, two or three more blocks are cut and excavated therein in the same sequence, and only then will a block be cut to the above-described pattern in the adjacent lower level A". The spacing in the strata direction of the two blocks being worked in the adjacent sublevels A', A" in general, i.e. the inter-sublevel lead, is selected so that any influence of the bearing rock pressure due to the stoping work in one block A' on the other block A" should be completely precluded, and vice versa. This distance is taken to be at least equal to the said limit length $L_n$ of the steady or self-supporting cantilever outreach or cantilever overhang of the rock of the main roof, with the given pattern of cutting into the bed with the cutting drifts and holes of the short working faces 12.

The limit length of the steady or self-supporting outreach of the cantilever of the rock of the main roof can be calculated from the following expression:

$$L_n = L_o + K \cdot b,$$

where $L_o$ is the pitch of caving-in the rock of the main roof, b is the width of the pillar between the adjacent stoping drifts, in meters, and K=4.48, that is a factor found by experience.

(See, for example, Provisional Instructions for Operating Systems of Mining Flat-Dipping and Sloping Beds with Short Working Faces partly located in the unloading zone, to be Complied With at the Hydraulic MInes of Kuznetski Deposit—prepared by the VNIIGI-DROUGOL of the Coal Mining Ministry of the USSR, Novokuznetsk, 1975).

The excavation in the short faces 12 in each block can be done in different suitable ways; however, preferably, in each of the blocks being worked in the adjacent sublevels, first, the complete pattern of the short working faces 12 is cut, and then the stoping is commenced therein, as it has been already described hereinabove.

Besides, it is expedient that while the short faces are being cut in one of two adjacent sublevels (A', A"), the stoping work should be carried out in the other sublevel (A', A").

This enables to step up considerably the excavation rate of the mineral, owing to the extended stoping front, and thus to increase several times over the excavation quota of the level being worked in, since this quota is no longer dependent on the condition of the extraction passages.

Moreover, the mining safety is significantly enhanced.

What is claimed is:

1. A method of mining flat-dipping and sloping beds of a mineable mineral with hydraulic excavation of the latter, including the steps of:

dividing a bed of the mineral to be mined into levels, said dividing step including driving a storage drift and a companion drift in the direction of the strata of said bed, and an airway of the service level, and connecting said drifts and said airway with connection holes;

dividing said sublevels into blocks and selecting the width of each block to be short of the value of the limit length of the steady outreach of a cantilever overhang of the main roof of the bed being mined, with the given pattern of cutting into this bed with the cutting drifts and holes defining the short working faces, setting the spacing in the strata direction of the blocks being mined in the adjacent ones of said sublevels at least equal to the value of the limit length of the steady outreach of the cantilever overhang of the main roof of the bed being mined, with the given pattern of cutting into this bed with the cutting drifts and the holes defining the short working faces, and precluding the influence of the bearing rock pressure due to the stoping work being done in either one of said blocks being mined onto another one of said blocks.

2. A method as set forth in claim 1, wherein in each one of said blocks being mined, firstly, completing the cutting of the pattern of said short working faces, and then carrying out the stoping work.

3. A method as set forth in claim 1 or 2, including conducting the cutting of said pattern of the short working faces in one of said adjacent sublevels while conducting the stoping work in the other one of said adjacent sublevels.

4. A method as set forth in claim 1 or 2, including the step of driving the sublevel storage drifts and the companion drifts with the same inclination as their level counterparts.

5. A method as set forth in claim 1 or 2, including the hydraulic extraction of the mineral in the short working faces and directing the stream of the water-mineral mixture produced through extraction holes connected with the storage drifts, the companion drifts and the connection holes.

6. A method as set forth in claim 1 or 2, wherein the limit length $L_n$ in meters of the steady outreach of the cantilever overhang of the main roof is determined by the following relationship:

$$L_n = L_o + K \cdot b,$$

where $L_o$ is the pitch of the caving-in of the rock of the main roof, b is the width of the pillar between adjacent stoping drifts, in meters, and K is a constant which is equal to 4.48.

* * * * *